United States Patent [19]

Hausermann

[11] Patent Number: 4,527,573

[45] Date of Patent: Jul. 9, 1985

[54] FILTER CIGARETTE

[75] Inventor: Max Hausermann, Richmond, Va.

[73] Assignee: Philip Morris Incorporated, New York, N.Y.

[21] Appl. No.: 439,588

[22] Filed: Nov. 5, 1982

[51] Int. Cl.[3] ..... A24B 3/04

[52] U.S. Cl. ..... 131/336; 131/198.2

[58] Field of Search ..... 131/198 A, 198 R, 336, 131/338-340

[56] References Cited

U.S. PATENT DOCUMENTS

| | | | |
|---|---|---|---|
| 1,015,723 | 1/1912 | Blackwood . | |
| 2,269,995 | 1/1942 | Trane . | |
| 2,693,193 | 11/1954 | Pelletier . | |
| 2,841,153 | 7/1958 | Pelletier . | |
| 2,923,647 | 2/1960 | Aghnides . | |
| 2,936,763 | 5/1960 | Saffir . | |
| 3,057,360 | 10/1962 | Bugge . | |
| 3,116,741 | 1/1964 | Speck . | |
| 3,232,299 | 2/1966 | Miller . | |
| 3,283,762 | 11/1966 | Kissel . | |
| 3,327,718 | 6/1967 | Kilburn | 131/336 |
| 3,359,988 | 12/1967 | Thomson | 131/336 |
| 3,376,874 | 4/1968 | Kim et al. | 131/338 |
| 3,441,028 | 4/1969 | Wall . | |
| 3,463,166 | 8/1969 | Bennett et al. . | |
| 3,503,406 | 3/1970 | Riegel et al. . | |
| 3,504,678 | 4/1970 | Pitt | 131/336 |
| 3,512,537 | 5/1970 | Pelletier . | |
| 3,519,000 | 7/1970 | Houser . | |
| 3,596,665 | 8/1971 | Lindgard | 131/336 |
| 3,601,131 | 8/1971 | Reggio . | |
| 3,608,561 | 9/1971 | Dock | 131/336 |
| 3,664,350 | 5/1972 | Wall . | |
| 3,685,522 | 8/1972 | Kleinhans . | |
| 3,695,274 | 10/1972 | Summers . | |
| 3,713,452 | 1/1973 | D'Elia et al. . | |
| 3,759,268 | 9/1973 | Plourde . | |
| 3,773,053 | 11/1973 | Stephens, Jr. . | |
| 3,774,622 | 11/1973 | Steigerwald . | |
| 3,789,855 | 2/1974 | Norman | 131/336 |
| 3,916,914 | 11/1975 | Brooks et al. . | |
| 4,201,234 | 5/1980 | Neukomm | 131/336 |
| 4,219,030 | 8/1980 | Hall . | |
| 4,232,574 | 11/1980 | Hall . | |
| 4,254,782 | 3/1981 | Ligeti . | |
| 4,340,074 | 7/1982 | Tudor | 131/362 |
| 4,343,319 | 8/1982 | Cantrell | 131/339 |
| 4,362,171 | 12/1982 | Johnson et al. . | |
| 4,365,641 | 12/1982 | Johnson | 131/338 |
| 4,369,796 | 1/1983 | Hall . | |
| 4,380,241 | 4/1983 | Horsewell . | |
| 4,433,696 | 2/1984 | Adams | 131/336 |

FOREIGN PATENT DOCUMENTS

| | | |
|---|---|---|
| 913486 | 10/1972 | Canada . |
| 874119 | 3/1953 | Fed. Rep. of Germany . |
| 1782545 | 9/1971 | Fed. Rep. of Germany . |
| 1034663 | 4/1953 | France . |
| 2422345 | 11/1979 | France . |
| 706624 | 3/1954 | United Kingdom . |
| 1058343 | 2/1967 | United Kingdom . |
| 1095848 | 12/1967 | United Kingdom . |
| 2099678 | 12/1982 | United Kingdom . |

*Primary Examiner*—V. Millin
*Assistant Examiner*—Gregory Beaucage
*Attorney, Agent, or Firm*—Jeffrey H. Ingerman

[57] ABSTRACT

A filter cigarette is provided which is adjustable to provide a wide range of air dilution values and which comprises a tobacco rod, a wrapped substantially cylindrical filter plug, and air transmissive tipping paper. The filter plug comprises a first mouth-end segment and a second, axially aligned, abutting rod-end segment which are joined such that the first segment is rotatable about the common axis. The second segment abuts and is joined to the tobacco rod. The wrapping is substantially air impermeable and has a plurality of first longitudinally extending, substantially air impermeable depressions spaced about the circumference of the first segment which are registrable with corresponding second, longitudinally extending, substantially air impermeable depressions spaced about the circumference of the second segment, such that as the first segment is rotated relative to the second segment, the degree of registry of the first and second depressions varies, thereby admitting varying amounts of air to the filter.

4 Claims, 9 Drawing Figures

FILTER CIGARETTE

BACKGROUND OF THE INVENTION

The present invention relates to filter cigarettes. More particularly, the present invention relates to filter cigarettes which are adjustable to provide a wide range of air dilution values.

Various mechanisms have been disclosed in heretofore issued patents which provide for adjustment of the air dilution value of a filter cigarette, but these mechanisms are not without certain disadvantages. While many complicated mechanisms have been disclosed, the simpler mechanisms generally involve making one or more openings through a substantially air impermeable filter plug wrap and the overlying, substantially air impermeable tipping paper and one or more corresponding openings in a sleeve which is placed over the tipping paper and which is then either rotated or moved axially to select the degree to which the two sets of openings are in registry. In another embodiment found in the art, the filter is not glued to the tipping paper and thus may be moved axially within the cylinder formed by the tipping paper. Openings are made in the filter plug wrap and corresponding openings are made in the tipping paper. The air dilution value is adjusted by axially moving the filter plug within the tipping paper to adjust the degree to which the two sets of openings are in registry.

Among the problems associated with such mechanisms are that the sleeve or filter plug may be removed from the cigarette by the smoker and not readily replaced, and that when dilution is desired, thus requiring some degree of registry between the two sets of openings, this registry may be inadvertently destroyed by a slight axial movement of the sleeve or plug. Accordingly, the dilution, once set by the smoker, is not insured of any degree of consistency. Yet another problem associated with a number of these prior devices is that they have not been readily adaptable to a high rate of production on cigarette making machinery of conventional design.

Accordingly, it is an object of the present invention to provide a filter cigarette which can be readily manufactured on conventional cigarette making equipment and that is adjustable to vary the ratio of air to smoke delivered to the mouth of the smoker.

SUMMARY OF THE INVENTION

A filter cigarette is provided which comprises a tobacco rod, that is, a charge of tobacco wrapped in cigarette paper, a wrapped substantially cylindrical filter plug, and air transmissive tipping paper. The cigarette is adjustable to provide a wide range of air dilution values. The air dilution value is the ratio of the volume of air to the volume of smoke exiting the mouth end of the filter and expressed as a percentage.

The tobacco rod and the filter plug are axially aligned in abutting end-to-end relation and are circumscribed by the tipping paper. The filter plug, which may be any conventional filter material such as cellulose acetate, has a mouth end and a rod end which are open to permit the passage of air and smoke. The filter plug comprises a first mouth-end segment and a second, axially aligned, abutting rod-end segment. The filter plug includes means joining the first and second segments such that the first segment is rotatable about the common axis.

The second segment abuts and is joined to the tobacco rod.

The wrapping is substantially air impermeable and has a plurality of first longitudinally extending, substantially air impermeable depressions spaced about the circumference of the first segment which are registrable with corresponding second longitudinally extending, substantially air impermeable depressions spaced about the circumference of the second segment, such that as the first segment is rotated relative to the second segment, the degree of registry of the first and second depressions varies, thereby admitting varying amounts of air to the interior of the first segment. The air enters through the air transmissive tipping paper and travels along the depressions into the exposed portions of the abutting ends of the first and second segments.

The air transmissive property of the tipping paper may be provided either by employing air permeable tipping paper or by providing a plurality of openings in air impermeable tipping paper which overlie and communicate with the depressions in the first segment or the second segment or both segments.

DESCRIPTION OF THE PREFERRED EMBODIMENTS

Figure 1:
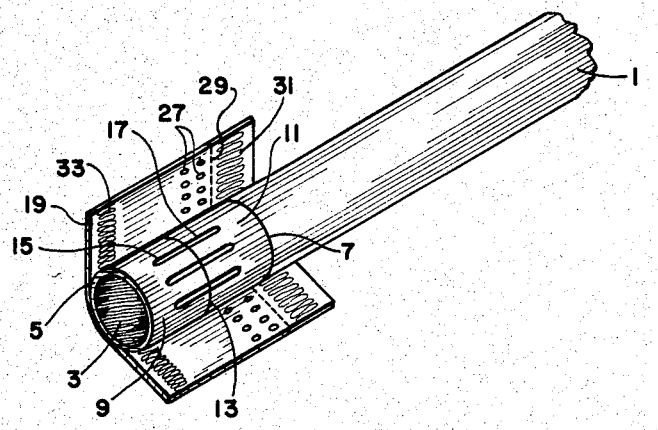
FIG. 1 is an enlarged, partially fragmentary, perspective view, taken from the mouth end, of a first preferred embodiment of the filter cigarette of the present invention.

The present invention will now be described with reference to FIGS. 1 through 9 in which like parts are given like reference numbers throughout.

Common to the preferred embodiments of the present invention are the following elements. A tobacco rod 1 comprising a substantially cylindrical charge of tobacco 21 enclosed in cigarette paper 23, is axially aligned in abutting end-to-end relation with filter plug 3, which comprises a first segment 9 and a second segment 11. The first and second segments are axially aligned and abut each other at the line of abutment 13. The second segment abuts the tobacco rod 1 at the line of abutment 7 and is joined thereto. Means are provided joining the first segment to the second segment for rotation of the first segment about the longitudinal axis of the cigarette. The first and second segments are wrapped in a substantially air impermeable plug wrap 5 which has a plurality of first depressions 15 which are substantially air impermeable and spaced about the circumference of the first segment. These depressions extend from a position intermediate the mouth end of the first segment and the line of abutment 13, to the line 13. A corresponding set of depressions 17, which are registrable with the first depressions, extend from the line 13 to a position intermediate line 13 and line 7. When the depressions 15 and 17 are in registry, the filter tow is not exposed and air does not flow through the tipping paper, along the depressions and into the filter tow. The filter plug 3 and the tobacco rod 1 are circumscribed by a layer of tipping paper 19 which extends from a position on the first segment to a position on the tobacco rod adjacent line 7.

The tipping paper 19 is air transmissive, and, as shown in the figures, comprises an air impermeable paper which is rendered air transmissive by means of rows of perforations 27, which communicate with the second set of depressions 17. In an alternative embodiment, the tipping paper 19 may be air permeable and the perforations 27 omitted. These perforations, when present, may overlie the second segment, or the first segment, or both segments. The perforations may be formed by conventional means known to those skilled in the art, such as electrostatic discharge, mechanical perforation, or laser perforation. The depressions may be formed by passing the filter rod between rollers having ridges which make the depressions in the plug wrap.

Means join the first and second segments such that the first segment is rotatable about the longitudinal axis of the cigarette. This means, in one preferred embodiment shown in the figures, is an extruded plastic rod 25. This embodiment may be formed by extruding a plastic rod, enveloping it in the filter tow and overwrapping with plug wrap. The filter is then slit circumferentially down to the extruded rod, whereby the first segment is rendered rotatable relative to the second segment. Alternatively, a conventional cellulose acetate filter may be cut circumferentially so as to leave a central core about which the first segment may be rotated, or a filter may be prepared having an axial core of a denser filter tow surrounded by a less dense filter tow and then circumferentially slit down to the denser core, thereby rendering the first segment rotatable relative to the second segment.

Figure 2:
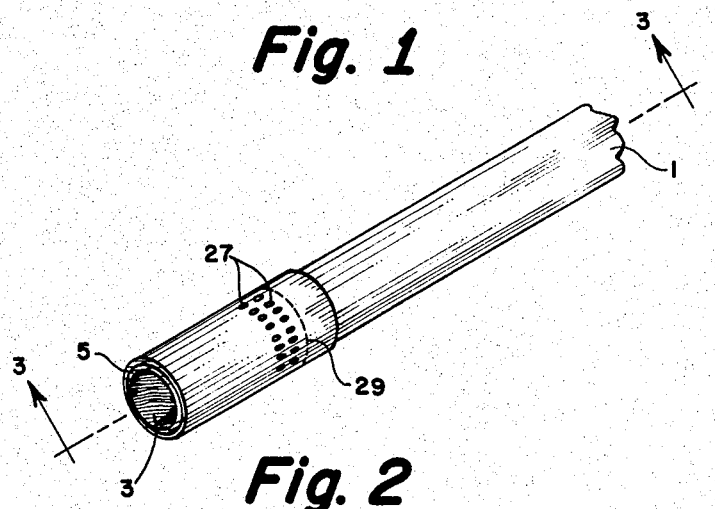
FIG. 2 is an enlarged perspective view, taken from the mouth end, of the assembled embodiment of FIG. 1.
Figure 3:
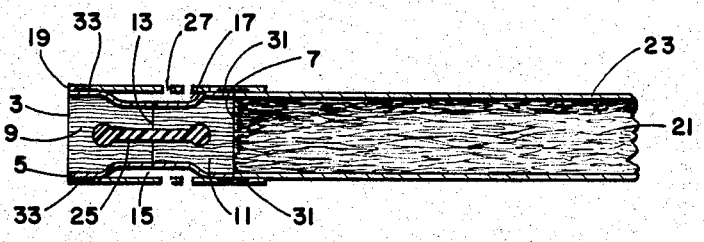
FIG. 3 is a cross-sectional view taken along the line 3—3 of FIG. 2.

In a first preferred embodiment shown in FIGS. 1 through 3, the tipping paper 19 extends from the mouth end of the first segment 9 to a position on the tobacco rod adjacent the line of abutment 7. The tipping paper 19 has a circumferentially extending row of closely spaced perforations forming a break-away line 29 which overlies the second segment intermediate the depressions 17 and the line of abutment 7. This line 29 divides the tipping paper into a mouth-end band and a rod-end band. The rod-end band attaches the second segment to the tobacco rod, preferably by means of an overlapping band of adhesive material 31 as shown in FIGS. 1 and 3. The mouth-end band is attached to the first segment 9, preferably by a band of adhesive 33 intermediate the mouth end and the depressions 15, as shown in FIGS. 1 and 3.

This embodiment may be fabricated using existing cigarette making equipment known to those skilled in the art with only minor modifications. The row of perforations 29 is preferably made employing a laser perforation system to provide closely spaced and small diameter perforations such that the line 29 retains only sufficient strength to remain intact during application of the tipping paper to the plug wrap and tobacco rod. Preferably the laser system is employed to make about 100 perforations per inch.

In practice, the mouth end of the cigarette and the tobacco column are grasped and rotated one relative to the other to break the row of perforations 29 and rotate the first segment, thereby varying the degree of registry of the depressions 15 and 17 and varying the amount of air flowing through the openings 27 into the depressions and then into the filter material where the air mixes with the smoke, thereby diluting the smoke and changing the air dilution value of the cigarette.

Figure 4:
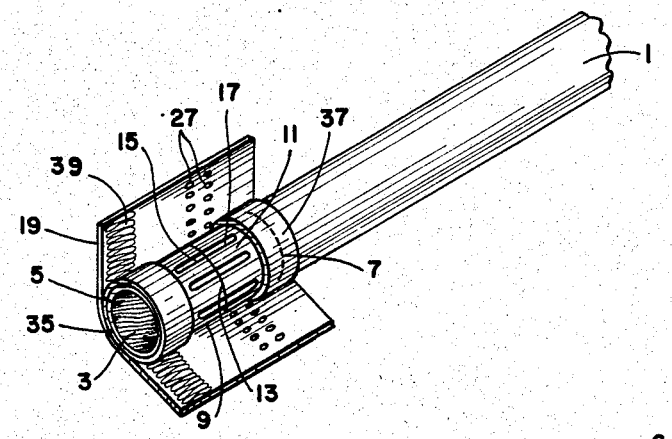
FIG. 4 is an enlarged, partially fragmentary, perspective view, taken from the mouth end, of a second preferred embodiment of the filter cigarette of the present invention.
Figure 5:
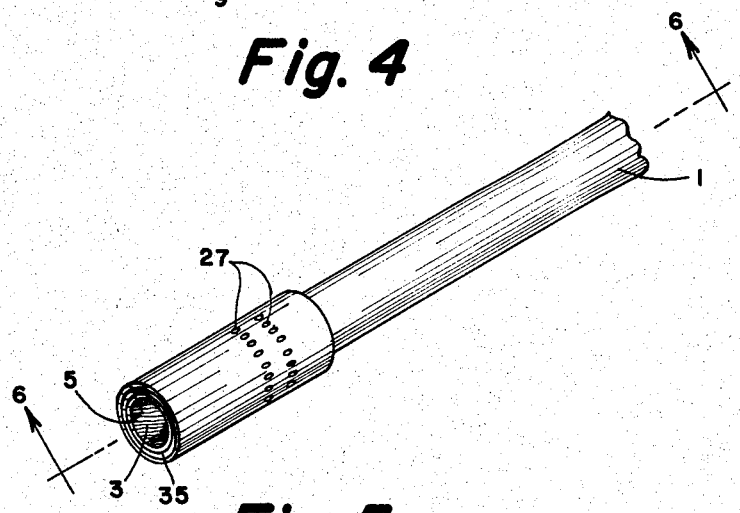
FIG. 5 is an enlarged perspective view, taken from the mouth end, of the assembled embodiment of FIG. 4.
Figure 6:
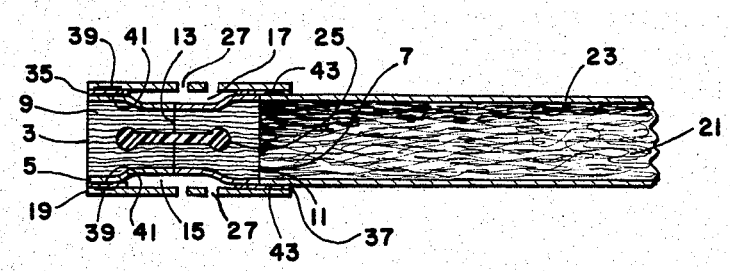
FIG. 6 is a cross-sectional view taken along the line 6—6 of FIG. 5.

In a second preferred embodiment shown in FIGS. 4 through 6, the tipping paper 19 extends as in the first embodiment but bands 35 and 37 are interposed between the tipping paper 19 and the plug wrap 5. The first band 35 extends from the mouth end of the filter plug 3 to a position intermediate the mouth end and the depressions 15. This band 35 is attached to the underlying plug wrap, preferably by an adhesive material 41. A second band extends from a position intermediate the depressions 17 and the line of abutment 7 to a position on the tobacco rod 1 which corresponds to the position of the rod end of the tipping paper 19. This band 37 joins the second segment 11 to the tobacco rod 1, preferably by means of an adhesive material 43. The tipping paper is attached only to the first band 35, preferably by means of an adhesive material 39. Thus, the entire tipping paper rotates with the first segment 9 about the longitudinal axis of the cigarette. Air dilution occurs as described for the first embodiment.

Figure 7:
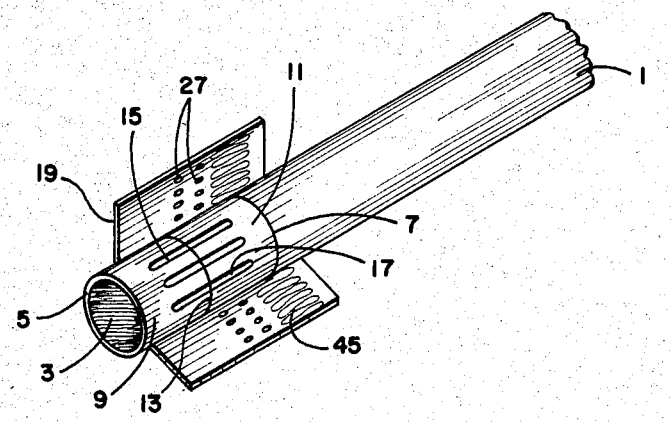
FIG. 7 is an enlarged, partially fragmentary, perspective view, taken from the mouth end, of a third preferred embodiment of the filter cigarette of the present invention.
Figure 8:
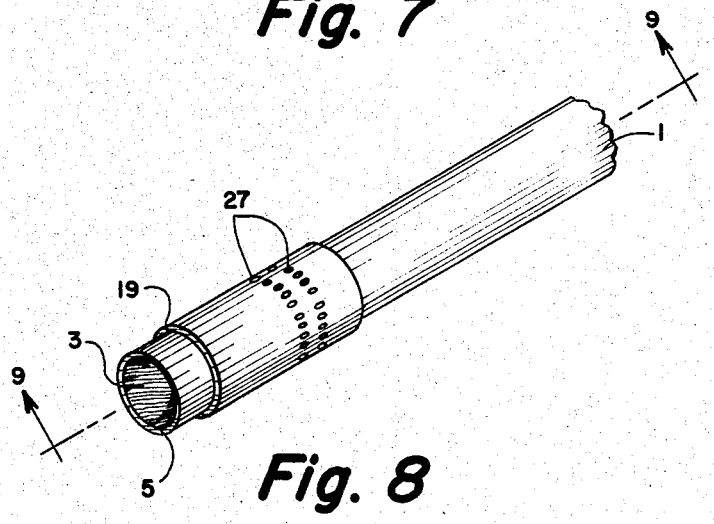
FIG. 8 is an enlarged perspective view, taken from the mouth end, of the assembled embodiment of FIG. 7.
Figure 9:
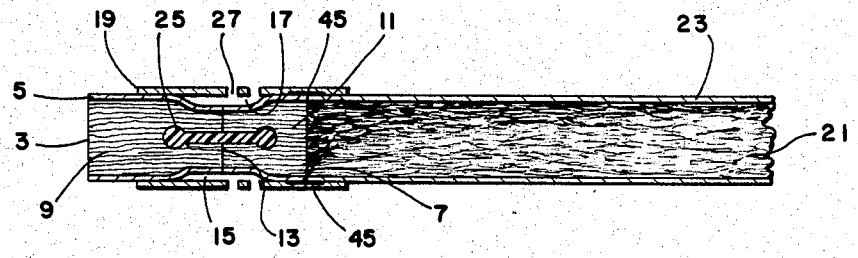
FIG. 9 is a cross-sectional view taken along the line 9—9 of FIG. 8.

In a third preferred embodiment, as shown in FIGS. 7 through 9, the tipping paper 19 extends from a position intermediate the mouth end of the first segment 9 and the depressions 15 to a position on tobacco rod 1 adjacent the line of abutment 7. The tipping paper joins the second segment 11 to the tobacco rod 1, preferably by means of an overlapping band of adhesive 45. Thus, the tipping paper is attached only to the tobacco column 1 and the second segment 11. The first segment 9 protrudes from the mouth end of the tipping paper 19 and may be grasped by the smoker and rotated within the tipping paper 19 to vary the degree of registry of the depressions 15 and 17. Air dilution occurs as described for the first embodiment.

It will be understood that the particular embodiments described are only illustrative of the principles of the present invention, and that various modifications can be made by those skilled in the art without departing from the scope and spirit of the present invention.

I claim:

1. A filter cigarette, comprising a tobacco rod, a wrapped substantially cylindrical filter plug having a first mouth-end segment and a second, axially aligned, abutting rod-end segment, each of said segments having a face abutting the other of said segments, means joining said first and second segments such that the first segment is rotatable about the common axis, means joining the second segment to the tobacco rod, and air transmissive tipping paper, said tobacco rod and said filter plug being axially aligned in abutting end-to-end relation and circumscribed by said tipping paper, said filter plug having a mouth end and a rod end open to permit the passage of air and smoke, said wrapping being substantially air impermeable and having a plurality of first longitudinally extending, substantially air impermeable depressions spaced about the circumference of the first segment extending from a position intermediate the ends of the first segment to the second segment, said first depressions being registrable with corresponding second, longitudinally extending, substantially air impermeable depressions spaced about the circumference of the second segment, such that as the first segment is rotated relative to the second segment, the degree of registry of the first and second depressions varies, thereby varying the amount of air admitted to the interior of the filter plug, a minimum amount of air being admitted when said depressions are fully in registry, and a maximum amount of air being admitted when said depressions are fully out of registry such that said abutting faces are exposed in the ends of said depressions.

2. The cigarette of claim 1 wherein the tipping paper extends from the mouth end of the filter plug to a position on the tobacco rod ajacent the line of abutment of the second segment with the tobacco rod, said tipping paper including a circumferentially extending row of closely spaced perforations overlying the second segment at a position intermediate the tobacco rod and the second depressions, thereby dividing said paper into a mouth-end band and a rod-end band, said mouth-end band being attached to the first segment for rotation therewith about the longitudinal axis, said rod-end band joining the second segment to the tobacco rod.

3. The cigarette of claim 1 including a first contiguous band extending from the mouth end of the filter plug to a position on the first segment intermediate the mouth end of the first depressions and the second segment and attached to the first segment for rotation therewith, said means joining the second segment to the tobacco rod comprising a second contiguous band extending from a position on the tobacco rod adjacent the second segment to a position on the second segment, said tipping paper overlying said first and second bands and extending from the mouth end of the filter plug to the tobacco rod end of the second band, said tipping paper being attached to said first band for rotation therewith.

4. The cigarette of claim 1 wherein the tipping paper extends from a position on the first segment intermediate the mouth end and the first depressions to a position on the tobacco rod adjacent the second segment, said tipping paper joining the second segment to the tobacco rod such that the first segment is rotatable within the tipping paper.

* * * * *